United States Patent [19]

Bond

[11] 4,138,036

[45] Feb. 6, 1979

[54] HELICAL COIL TUBE-FORM INSERT FOR FLEXIBLE BAGS

[75] Inventor: Curtis J. Bond, Marion, Ohio

[73] Assignee: Liqui-Box Corporation, Worthington, Ohio

[21] Appl. No.: 828,632

[22] Filed: Aug. 29, 1977

[51] Int. Cl.[2] ..... B65D 35/56

[52] U.S. Cl. ..... 222/105; 222/464

[58] Field of Search ..... 222/94, 95, 464, 382, 222/211, 183, 386.5, 547, 564, 408.5, 459, 230, 1; 220/441

[56] References Cited

U.S. PATENT DOCUMENTS

| | | | |
|---|---|---|---|
| 1,038,181 | 9/1912 | Mossberg | 222/211 |
| 3,043,316 | 7/1962 | Bolser | 222/564 X |
| 3,090,526 | 5/1963 | Hamilton et al. | 220/441 X |
| 3,138,293 | 6/1964 | Roak et al. | 222/105 |
| 3,549,050 | 12/1970 | Bruce | 222/464 X |
| 4,062,475 | 12/1977 | Harris et al. | 222/95 |

*Primary Examiner*—Stanley H. Tollberg
*Assistant Examiner*—Francis J. Bartuska
*Attorney, Agent, or Firm*—Wm. V. Miller

[57] ABSTRACT

A helical coil winding inserted in a flexible bag, such as a plastic bag, and connected to or associated with the dispensing spout or neck opening thereof. The helical coil will extend into the bag and will provide a form, about which the flexible wall of the bag will collapse and form, to provide a dispensing tube or passageway leading to the bag spout, as the contents of the bag are removed as a result of a pumping action, suction action or other condition resulting in differential pressure causing collapse of the bag.

4 Claims, 10 Drawing Figures

FIG. 5
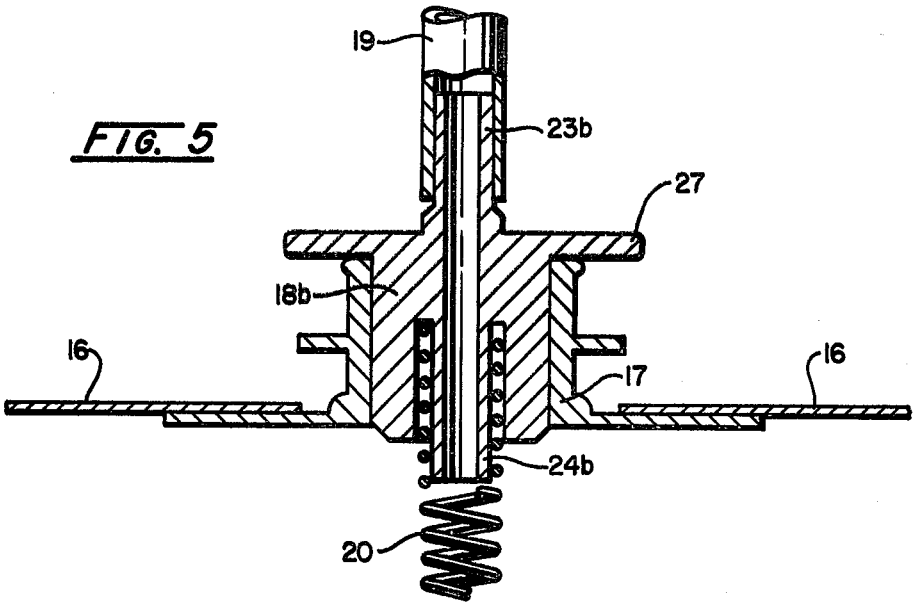
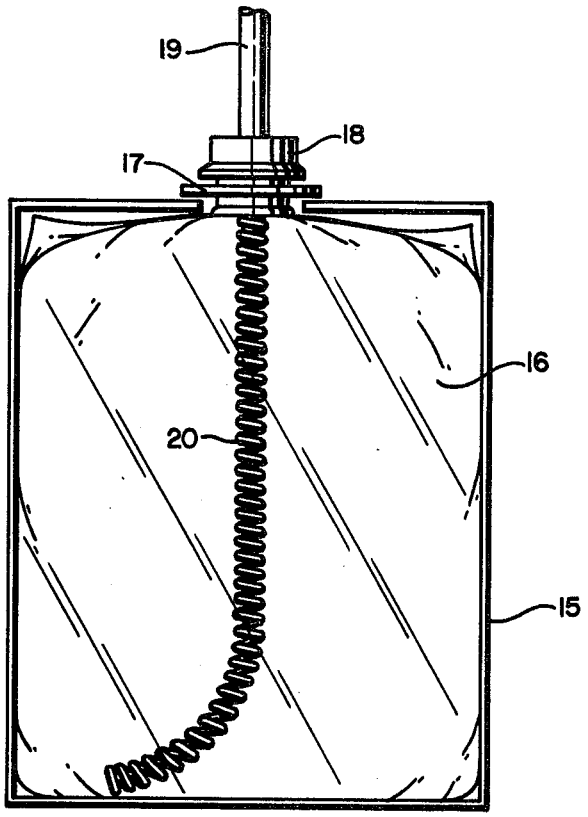
FIG. 6

HELICAL COIL TUBE-FORM INSERT FOR FLEXIBLE BAGS

BACKGROUND OF THE INVENTION

Plastic bags or pouches are made of flexible plastic film and are in common use for packaging many products, either with or without a protective outer box. A type with a protective box is illustrated generally by U.S. Pat. No. 3,090,526. The bags usually have spouts or necks of more rigid plastic attached thereto through which the bags are filled and the contents removed. It is desirable to remove the contents by pumping or evacuating but because the walls of the bags are flexible, this is difficult unless some means is provided for preventing the walls from collapsing. In the attempt to evacuate through the spout, removal of a small part of the contents of the bag will cause its walls to collapse and close the discharge or dispensing opening of the neck at its inner end. If a pump is used and a solid wall probe or tube is extended completely into the bag so that its open inlet end is adjacent the bottom of the bag, the flexible bag wall is often drawn inwardly to close this outlet, especially if the bag is disposed on its side. Thus, there is need for a simple inexpensive means for providing an outlet from the bag during removal of the bag contents by any method causing a pressure differential on the bag and resulting collapse of its walls.

SUMMARY OF THE INVENTION

This invention provides a very simple and inexpensive tube-form which is inserted in the bag as a connection to the bag spout for a single-service application and disposal with the bag, or as a connection to a repeat-service adapter fitting into the spout and which is connected to an outlet tube. It is made of a helix of plastic or wire, or plastic-coated wire, and will be connected in axial alignment with the spout opening and extend inwardly into the bag where it will be free to bend or flex laterally realtive to its axis. It will preferably be of greater axial extent than the axial extent of the bag and have its free end at the closed end of the bag.

This simple coil will serve as a form, about which the flexible walls of the bag will form as they collapse due to any pressure-differential on the bag. The walls of the bag will form, around the coil, a dispensing or evacuating passageway leading from the bag to the discharge or opening of the spout and which will be in communication with the contents of the bag until it is completely emptied.

BRIEF DESCRIPTION OF THE DRAWINGS

The best mode contemplated in carrying out this invention is illustrated in the accompanying drawings in which:

FIG. 5 is an enlarged detail in axial section showing how the coil may be attached to a repeat-service adapter which may be connected to a pumping source.

FIG. 6 is a schematic view showing a filled bag resting in a box with the coil of this invention connected to the spout and inserted in the bag.

DETAILED DESCRIPTION OF THE INVENTION

Figure 1:
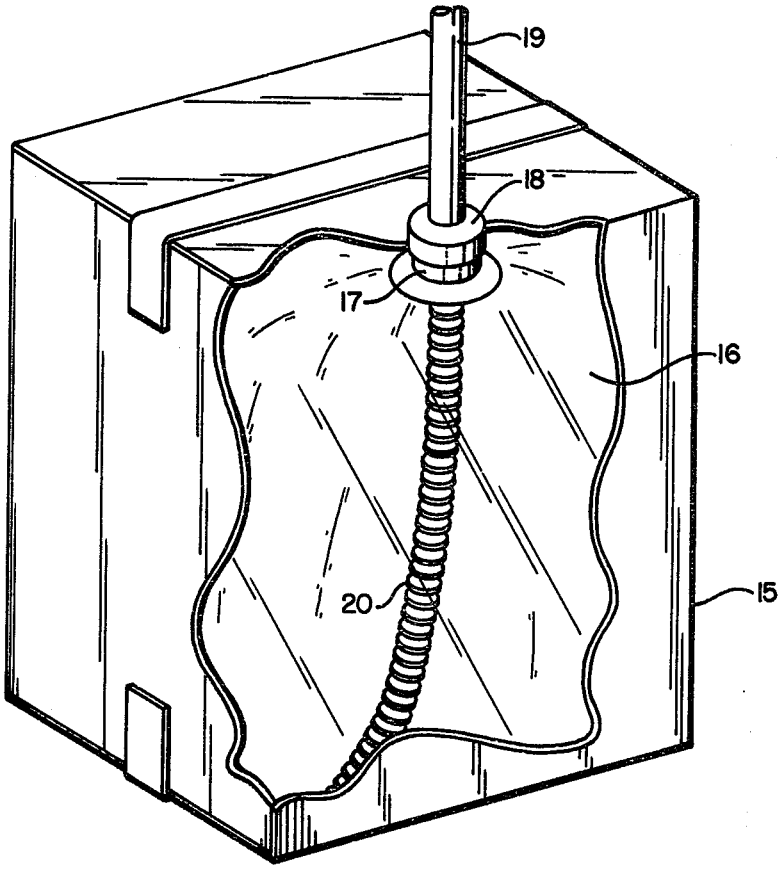
FIG. 1 is a perspective view of a bag and box to which this invention has been applied.

With specific reference to the drawings, in FIG. 1 there is illustrated a package assembly to which this invention is applied. It includes a corrugated protective box 15 in which a filled bag 16 of thin plastic film is disposed in upright position. The upper end of the bag is provided with a spout 17, through which it can be filled and emptied. The spout has an adapter 18 mounted thereon so that it can be connected to a hose 19 which may connect to a pump or other evacuating means. Carried by the spout 17 and extending downwardly into the bag to the bottom thereof is a coil 20 provided in accordance with this invention.

Figure 2:
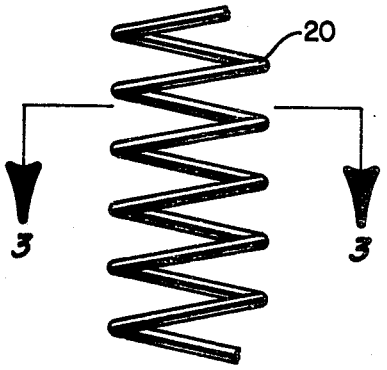
FIG. 2 is a side elevational view of a portion of the helical coil used in the invention.
Figure 3:
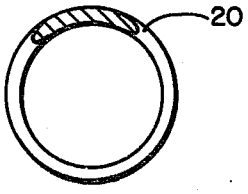
FIG. 3 is a transverse sectional view taken along line 3—3 of FIG. 2.
Figure 4:
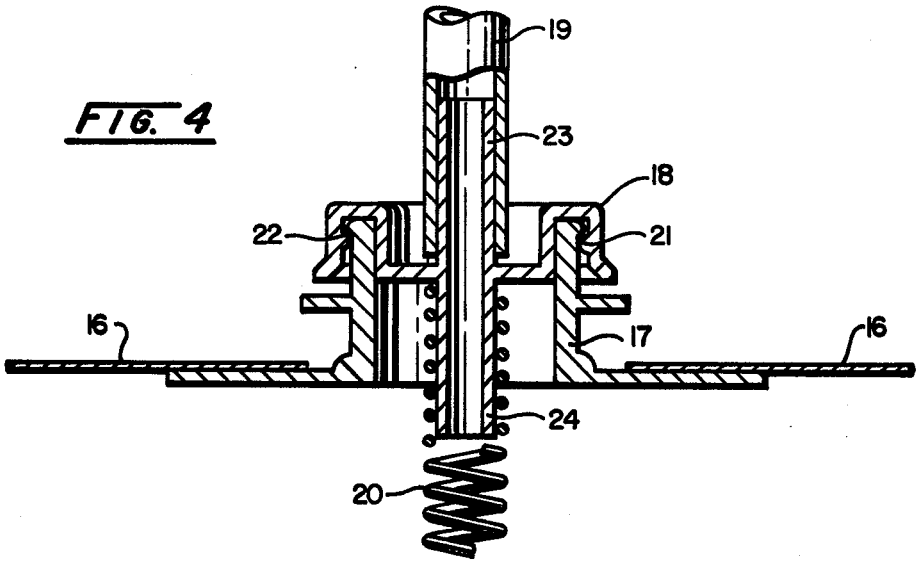
FIGS. 4 and 4*a*, each is an enlarged detail in axial section showing how the coil may be attached to an adapter mounted on the spout of the bag.
Figure 4A:
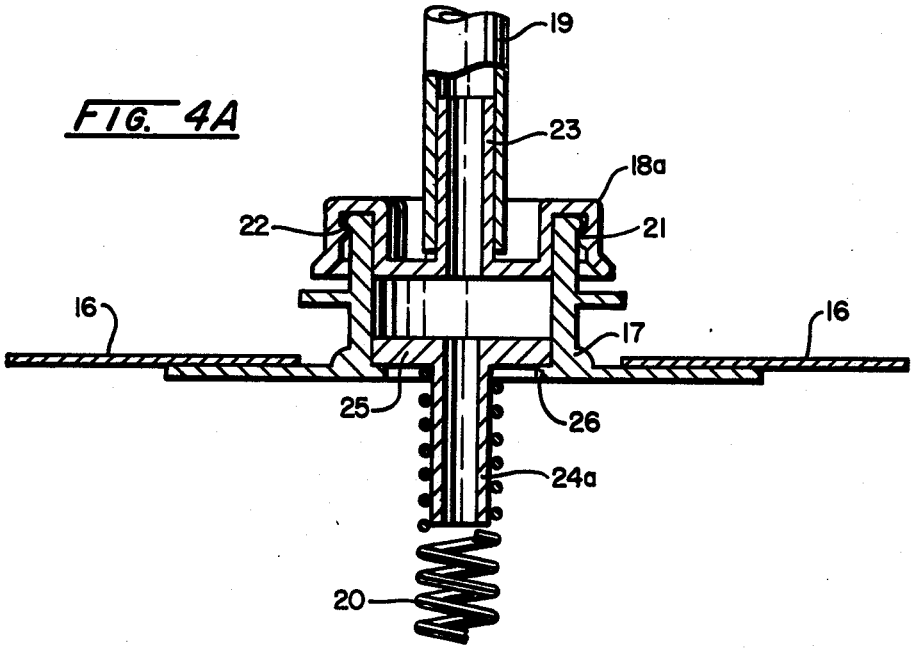

The coil 20 may be made as a helix of a suitable resilient plastic, with sufficient resilience that it will tend to return to its original shape if it is bent bodily along its axis or even if it is flattened towards its axis. It, however, can be made of wire or of wire-coated with a suitable plastic. The convolutions of the helix, as shown in FIGS. 2 and 3, are preferably of uniform diameter although they could be of gradually increasing or decreasing diameter along its length. One end of the helix is to be mounted in the spout 16 concentric therewith and the other end is to be free to move within the bag 16, as indicated in FIG. 1. Examples of how the helical coil can be supported are illustrated in FIGS. 4, 4*a* and 5.

The arrangement of FIG. 4 or 4*a* will be used when it is to be a single service application, that is, the unit will be supplied with the bag and will be described, after the bag is emptied, along with the bag. In the form of FIG. 4, the upper end of the helix 20 will be slipped over a depending sleeve 24 formed integral on the adapter 18 and will be frictionally held in place. The adapter 18 will have a double skirt that removably snaps over the upper exposed edge of the spout 17 and will be locked in place by the internal annular rib 21 thereof snapping into an external locking groove 22 in the exterior of the spout. The adapter 18 will have an outward extension 23 over which the hose 19 may be slipped. The adapter unit of FIG. 4*a* is similar except that sleeve 24*a* is on a disc 25 which slips into the spout and rests on lip 26. The upper part 18*a* is of the form previously described.

Figure 7:
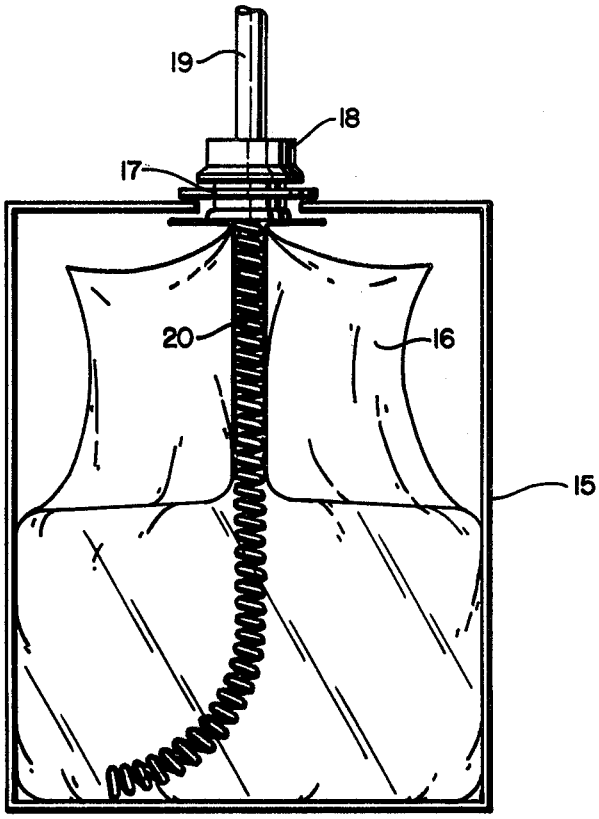
FIG. 7 is a similar view but showing the bag partially emptied of its contents and the upper portion of the flexible bag wall collapsed and forming a dispensing tube around the coil.
Figure 8:
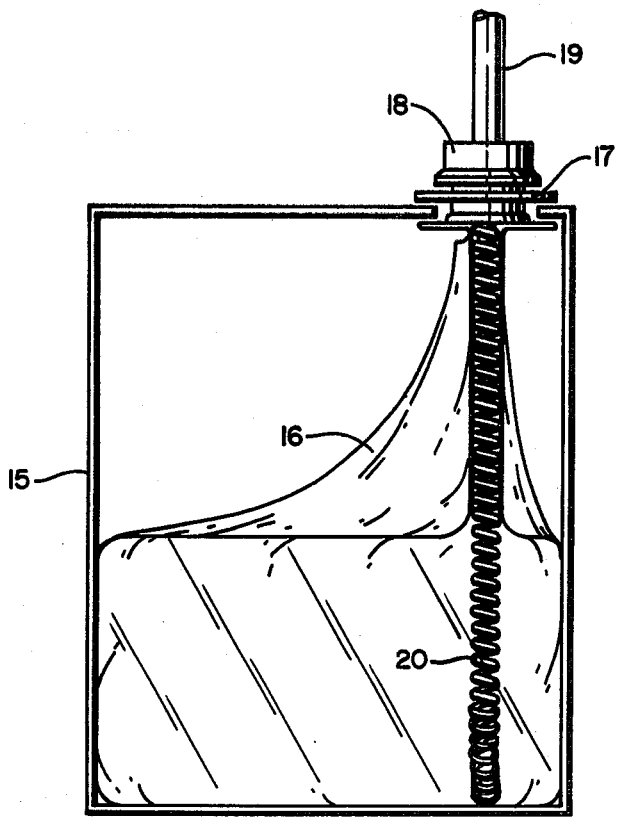
FIG. 8 is a view similar to FIG. 7 but with the bag turned at a right angle thereto.
Figure 9:
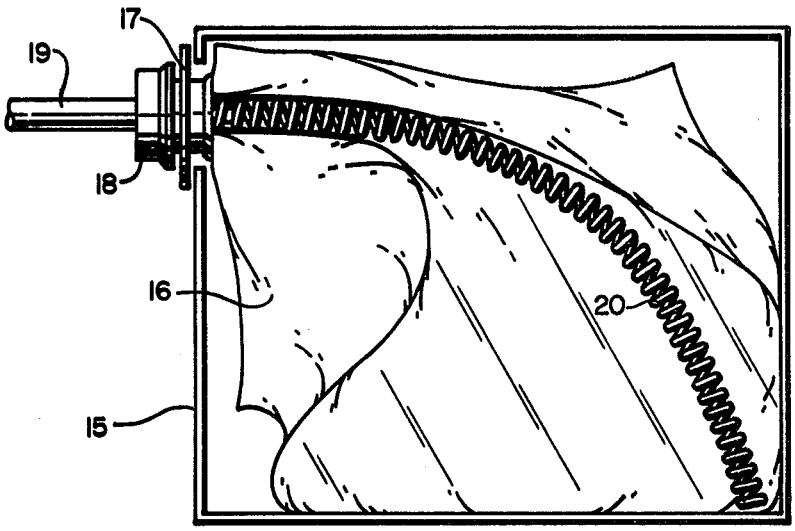
FIG. 9 is a view similar to FIG. 8 but showing the box in horizontal position rather than in vertical position.

Thus, the helical coil 20 will be mounted on the adapter 18 or adapter part 25 concentric therewith and, when the adapter is mounted on the spout 17, will be concentric therewith. The helical coil 20 will extend into the bag 16 to the bottom thereof and preferably into contact therewith so it will provide a form around which the flexible wall of the bag can collapse and form. The helix 20 is of greater axial extent than the axial distance from the spout to the closed bottom of the bag 16. The helix has the passages or spaces between its convolutions for the length thereof through which the bag contents can flow. Consequently, as indicated in FIGS. 1, 7 and 8, if the bag is disposed vertically in the upright box 17, and evacuation is started through the tube 19, the upper part of the bag will collapse and will gradually and progressively form a tube or passageway downwardly along the helix form 20. The remainder of the helix will be in communication with the contents of the bag, as the tube gradually forms downwardly therealong, so that all the contents of the bag can be evacuated all the way to its bottom.

Instead of having the adapter mounted on the bag 16 and carrying the helix 20, it can be carried by a repeat-service adapter **18*b* of the type shown in FIG. 5 which may be inserted into the spout 17 only during evacuation and can be used repeatedly with successive bags 16. This adapter may have a solid body of plastic or metal which is inserted into the spout 17 to a lower position determined by stop flange 27. It will have the outward extension 23*b* for receiving the end of the tube 19 and an inward extension 24*b*, and associated socket, for receiving the upper end of the helix 20. During the evacuation of bag 16 by this arrangement, the helical coil 20** will have exactly the same function as before.

Thus, the helical coil 20 provides a tube-form, with a main axial passageway and inlet passages along its length, about which the bag wall can collapse and form a dispensing tube progressively along its length as the bag contents are withdrawn. Since the coil provides for inlet passages throughout its length, the bag contents will be completely emptied. The coil may be supplied separately from the bag and later be inserted into the bag or be supplied on the bag spout already inserted into the bag. Alternately, the coil may be attached to a repeat-service adapter which is inserted in the spouts of successive bags and used repeatedly.

The strip which forms the helix 20 may be of circular cross-section as shown in FIG. 3 or of any other cross-section such as oval or angular.

In the preceeding examples, it has been indicated that the bag is emptied by pumping or evacuation and that the container package is a bag in a box. However, this invention is applicable to other types of packages where the bag collapses as a result of a pressure-differential condition during emptying of the bag. For example, the bag may be within a surrounding gas-pressure container which will cause it to collapse as the contents of the bag are discharged.

Having thus described this invention, what is claimed is:

1. In combination with a flexible bag having a dispensing spout with an opening through which the bag contents may be removed, means for facilitating removal of the bag contents by a pressure-differential on the bag, said means comprising a helical coil having one end leading into the spout opening and the other end extending into the bag so that as the contents of the bag are removed, an outlet tube can form there-around by the progressively collapsing wall of the bag, said coil being a formed helix which is resiliently flexible to permit bending along its length and which has its one end disposed concentric with the spout, an adapter device removably mounted on the spout and having an inwardly extending tube connection for receiving said end of said helix for mounting, it concentrically on the spout and also having an outwardly extending tube connection for receiving an outlet tube said adapter device having a double skirt which slips over an exposed edge of the spout and is locked thereto.

2. The combination of claim 1 in which the adapter device consists of two parts, one of which is the double skirt and carries the outwardly extending tube connection and the other of which fits into the spout and carries the inwardly extending tube connection.

3. The combination of claim 1 in which the bag has a closed end removed from the spout and the helical coil is flexible and of sufficient length to extend into contact with that end.

4. The combination of claim 1 in which the helical coil is of greater axial extent than the bag.

* * * * *